US011740570B1

(12) United States Patent
Kasukawa

(10) Patent No.: US 11,740,570 B1
(45) Date of Patent: Aug. 29, 2023

(54) IMAGE FORMING APPARATUS

(71) Applicant: TOSHIBA TEC KABUSHIKI KAISHA, Tokyo (JP)

(72) Inventor: Masayuki Kasukawa, Misato Saitama (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/751,722

(22) Filed: May 24, 2022

(51) Int. Cl.
*G03G 15/08* (2006.01)
*G03G 21/00* (2006.01)

(52) U.S. Cl.
CPC ..... *G03G 15/0812* (2013.01); *G03G 21/0029* (2013.01)

(58) Field of Classification Search
CPC ..... G03G 15/0812; G03G 21/0029
See application file for complete search history.

(56) References Cited

U.S. PATENT DOCUMENTS 4,577,955 A * 3/1986 Mayer ..... G03G 21/0029 399/350
9,811,049 B2 * 11/2017 Suzuki ..... G03G 21/00
11,592,761 B1 * 2/2023 Kasukawa ..... G03G 15/0812
2006/0104676 A1 * 5/2006 Dickerson ..... G03G 15/0812 399/284
2014/0119781 A1 5/2014 Okuno et al.
2020/0333741 A1 * 10/2020 Ishihara ..... G03G 15/751

FOREIGN PATENT DOCUMENTS

JP 59100482 A * 6/1984
JP 01-219859 9/1989
JP 02-25877 1/1990
JP 2008-122459 5/2008

* cited by examiner

*Primary Examiner* — Ryan D Walsh
(74) *Attorney, Agent, or Firm* — Amin, Turocy & Watson, LLP

(57) ABSTRACT

An image forming apparatus includes a developing case, a developing sleeve, a doctor blade, a first engaging section, and a second engaging section. The developing sleeve is supported by the developing case at both ends. The doctor blade includes both end portions in a longitudinal direction and a straight end face. The first engaging section is provided in the center in the longitudinal direction of the doctor blade. The second engaging section is provided in the developing case and engages with the first engaging section. One of the first engaging section and the second engaging section includes a shaft member having a predetermined axis. The other of the first engaging section and the second engaging section includes a recess including a pair of guide sections inclined with respect to the end face of the doctor blade.

20 Claims, 14 Drawing Sheets

IMAGE FORMING APPARATUS

FIELD

Embodiments described herein relate generally to an image forming apparatus and a developer handling device.

BACKGROUND

An image forming apparatus receives toner from a toner cartridge and performs an image forming process for forming a toner image on a photoconductive drum. The image forming apparatus transfers the toner image on the photoconductive drum onto a printing medium.

DETAILED DESCRIPTION

According to an embodiment, an image forming apparatus includes a developing case, a developing sleeve, a doctor blade, a first engaging section, and a second engaging section. The developing case stores a developer including a carrier and toner supplied from a toner cartridge. The developing sleeve is supported by the developing case at both ends and causes the developer to adhere to an outer surface of the developing sleeve with a magnetic force. The doctor blade includes both end portions in a longitudinal direction supported by the developing case and a straight end face separated from the outer surface of the developing sleeve. The first engaging section is provided in a center in the longitudinal direction of the doctor blade. The second engaging section is provided in the developing case and engages with the first engaging section. One of the first engaging section and the second engaging section includes a shaft member having a predetermined axis in a direction crossing the end face of the doctor blade. The other of the first engaging section and the second engaging section includes a recess including a pair of guide sections inclined with respect to the end face of the doctor blade and guided in a state in which an outer edge of the shaft member is fit in the recess.

An image forming apparatus 1 according to first and second embodiments is explained below with reference to the drawings.

First Embodiment

Figure 1:
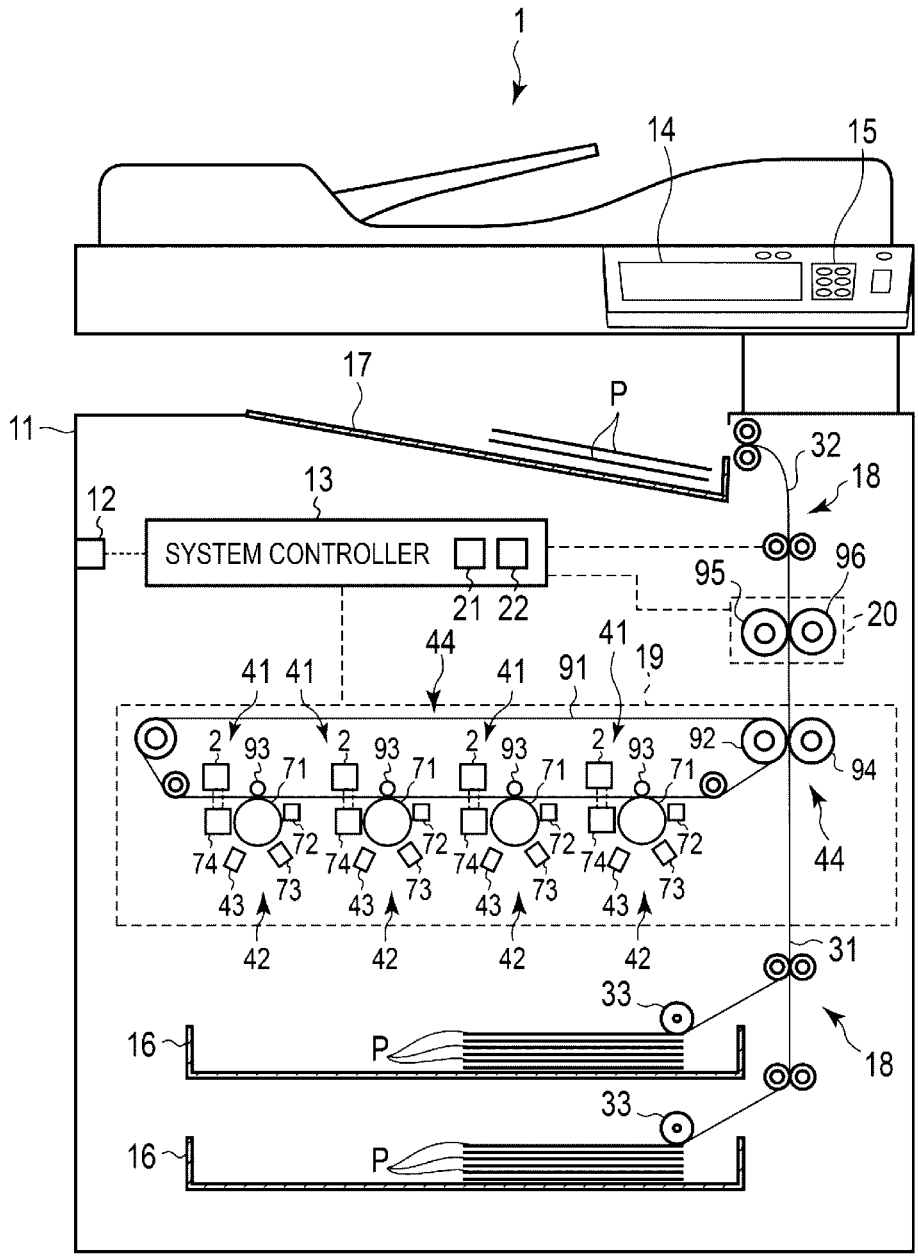
FIG. 1 is a diagram for explaining a configuration example of an image forming apparatus according to first and second embodiments.

FIG. 1 is an explanatory diagram for explaining a configuration example of the image forming apparatus 1 according to the first embodiment.

The image forming apparatus 1 is, for example, a multifunction printer (MFP) that performs various kinds of processing such as image formation while conveying a recording medium such as a printing medium. The image forming apparatus 1, for example, a printer of solid-state scanning type for scanning an LED array (for example, an LED printer) that performs various kinds of processing such as image formation while conveying a recording medium such as a printing medium.

For example, the image forming apparatus 1 receives toners from toner cartridges 2 and forms an image on a printing medium with the received toners. The toners may be single color toner or may be color toners of colors such as cyan, magenta, yellow, and black.

As illustrated in FIG. 1, the image forming apparatus 1 includes a housing 11, a communication interface 12, a system controller 13, a display unit 14, and operation interface 15, a plurality of paper trays 16, a paper discharge tray 17, a conveying unit 18, an image forming unit 19, and a fixing device 20.

The housing 11 is a main body of the image forming apparatus 1. The housing 11 houses the communication interface 12, the system controller 13, the display unit 14, the operation interface 15, the plurality of paper trays 16, the paper discharge tray 17, the conveying unit 18, the image forming unit 19, and the fixing device 20.

The communication interface 12 is an interface for communicating with other equipment. The communication interface 12 is used for, for example, communication with a host apparatus (external equipment). The communication interface 12 is, for example, an LAN connector. The communication interface 12 may perform wireless communication with the other equipment according to a standard.

The system controller 13 controls the image forming apparatus 1. That is, the system controller 13 controls the communication interface 12, the display unit 14, the operation interface 15, the conveying unit 18, the image forming unit 19, and the fixing device 20.

The system controller 13 performs various kinds of processing based on data such as programs stored in a memory. The system controller 13 performs various kinds of information processing by executing the programs stored in the memory. The system controller 13 generates a printing job, for example, based on an image acquired from the external equipment via the communication interface 12. The system controller 13 stores the generated printing job in the memory. The printing job includes image data indicating an image to be formed on a printing medium P. The image data may be data for forming an image on one printing medium P or may be data for forming images on a plurality of printing media P. Further, the printing job includes information indicating whether printing is color printing or monochrome printing.

The system controller 13 executes the programs stored in the memory to thereby function as a controller that controls the operations of the conveying unit 18, the image forming unit 19, and the fixing device 20. That is, the system controller 13 controls conveyance of the printing medium P by the conveying unit 18, formation of an image on the printing medium P by the image forming unit 19, fixing of the image on the printing medium P by the fixing device 20, and the like.

The display unit 14 includes a display that displays an image according to a video signal input from the system controller 13 or a not-illustrated display control unit such as a graphic controller. For example, a screen for various settings for the image forming apparatus 1 and information such as a toner residual amount are displayed on a display of the display unit 14.

The operation interface 15 is connected to not-illustrated operation members. The operation interface 15 supplies an operation signal corresponding to operation of the operation members to the system controller 13. The operation members are, for example, a touch sensor, ten keys, a power key, a paper feed key, various function keys, and a keyboard. The touch sensor acquires information indicating a position designated in a certain region. The touch sensor is configured as a touch panel integrally with the display unit 14. The touch sensor inputs, to the system controller 13, a signal indicating a touched position on a screen displayed on the display unit 14.

Each of the plurality of paper trays 16 is a cassette that stores the printing media P. The paper tray 16 is capable of supplying the printing media P from the outside of the housing 11. For example, the paper tray 16 can be drawn out from the housing 11.

The paper discharge tray 17 is a tray that supports the printing medium P discharged from the image forming apparatus 1.

A configuration for conveying the printing medium P of the image forming apparatus 1 is explained.

The conveying unit 18 is a mechanism for conveying the printing medium P in the image forming apparatus 1. As illustrated in FIG. 1, the conveying unit 18 includes a plurality of conveying paths. For example, the conveying unit 18 includes a paper feed conveying path 31 and a paper discharge conveying path 32.

Each of the paper feed conveying path 31 and the paper discharge conveying path 32 includes a plurality of motors, a plurality of rollers, and a plurality of guides. The plurality of motors rotate a shaft based on the control by the system controller 13 to thereby rotate a roller interlocking with the rotation of the shaft. The plurality of rollers rotate to thereby move the printing medium P. The plurality of guides control a conveying direction of the printing medium P.

The paper feed conveying path 31 takes in the printing medium P from the paper tray 16 and supplies the taken-in printing medium P to the image forming unit 19. The paper feed conveying path 31 includes pickup rollers 33 corresponding to the paper trays 16. Each of the pickup rollers 33 takes the printing medium P in the paper tray 16 into the paper feed conveying path 31.

The paper discharge conveying path 32 is a conveying path for discharging, from the housing 11, the printing medium P on which an image is formed. The printing medium P discharged by the paper discharge conveying path 32 is supported by the paper discharge tray 17.

The image forming unit 19 is explained.

The image forming unit 19 is a component that forms an image on the printing medium P. Specifically, the image forming unit 19 forms an image on the printing medium P based on a printing job generated by the system controller 13.

The image forming unit 19 includes a plurality of loading units 41, a plurality of process units 42, a plurality of exposing devices 43, and a transfer mechanism 44. The image forming unit 19 includes the loading unit 41 and the exposing device 43 for each of the process units 42. The plurality of process units 42, the plurality of loading units 41, and the plurality of exposing devices 43 are respectively the same components. Therefore, one process unit 42, one loading unit 41, and one exposing device 43 are explained as an example.

Figure 2:
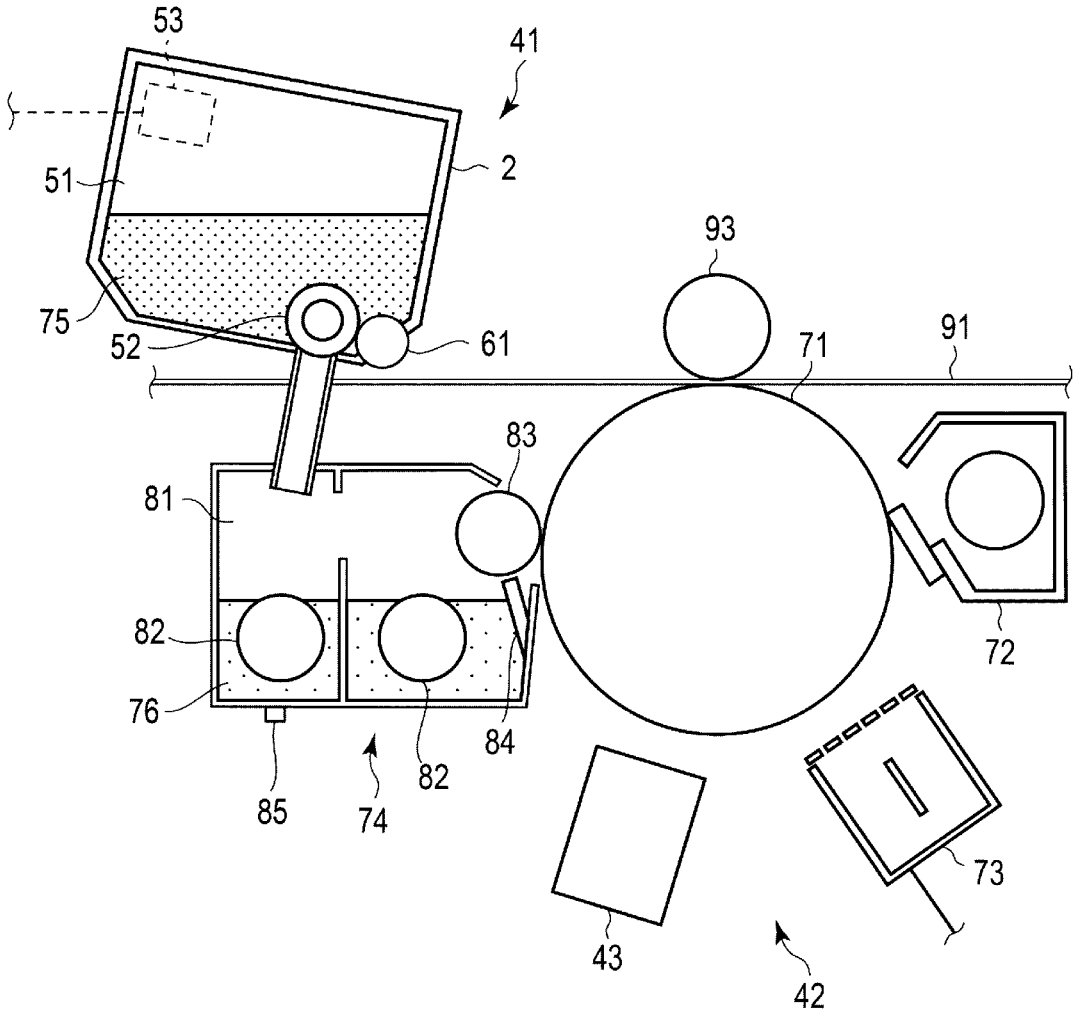
FIG. 2 is a diagram for explaining a configuration example of a part of an image forming unit according to the first and second embodiments.

FIG. 2 is an explanatory diagram for explaining an example of the configuration of a part of the image forming unit 19.

First, the toner cartridge 2 attached to the loading unit 41 is explained.

As illustrated in FIG. 2, the toner cartridge 2 includes a toner storage container 51 and a toner feed-out mechanism 52.

The toner storage container 51 is a container that stores toner.

The toner feed-out mechanism 52 is a mechanism for feeding out the toner in the toner storage container 51. The toner feed-out mechanism 52 is, for example, a screw that is provided in the toner storage container 51 and rotates to thereby feed out the toner.

The loading unit 41 to which the toner cartridge 2 is attached is explained.

As illustrated in FIG. 2, the loading unit 41 is a module to which the toner cartridge 2 filled with toner is attached. Each of the plurality of loading units 41 includes a space in which the toner cartridge 2 is attached and a toner supply motor 61. Each of the plurality of loading units 41 includes a communication interface that connects a memory 53 of the toner cartridge 2 and the system controller 13.

The toner supply motor 61 drives the toner feed-out mechanism 52 of the toner cartridge 2 based on the control by the system controller 13. If the toner cartridge 2 is loaded in the loading unit 41, the toner supply motor 61 is connected to the toner feed-out mechanism 52 of the toner cartridge 2. The toner supply motor 61 is energized based on the control by the system controller 13 to thereby rotate a shaft and drive the toner feed-out mechanism 52 of the toner cartridge 2. The toner supply motor 61 drives the toner feed-out mechanism 52 to thereby supply the toner in the toner storage container 51 to a developing device 74 explained below.

The process unit 42 is explained.

The process unit 42 forms a toner image. For example, the plurality of process units 42 are provided for each of kinds of toners. For example, the plurality of process units 42 respectively correspond to color toners such as cyan, magenta, yellow, and black toners. Specifically, the toner cartridges 2 storing different color toners are connected to the process units 42.

As illustrated in FIG. 2, the process unit 42 includes a photoconductive drum 71, a cleaner 72, an electrifying charger 73, and the developing device 74.

The photoconductive drum 71 is a photoconductive body including a cylindrical drum and a photoconductive layer formed on the outer circumferential surface of the drum. The photoconductive drum 71 is rotated at constant speed by a driving mechanism.

The cleaner 72 removes toner remaining on the surface of the photoconductive drum 71.

The electrifying charger 73 uniformly charges the surface of the photoconductive drum 71. For example, the electrifying charger 73 applies a voltage to the photoconductive drum 71 using a charging roller to thereby charge the photoconductive drum 71 to uniform negative polarity potential. The charging roller is rotated by the rotation of the photoconductive drum 71 in a state in which the charging roller applies predetermined pressure to the photoconductive drum 71.

Figure 3:
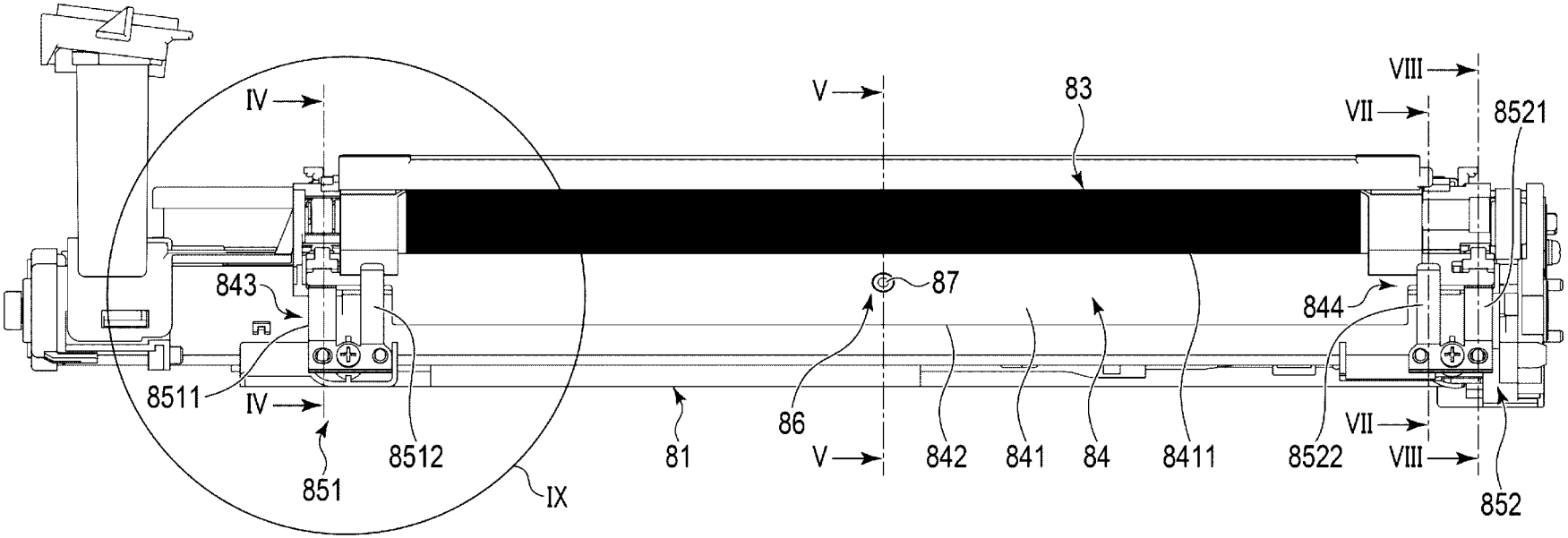
FIG. 3 is a diagram illustrating a developing device of the image forming unit according to the first embodiment.
Figure 4:
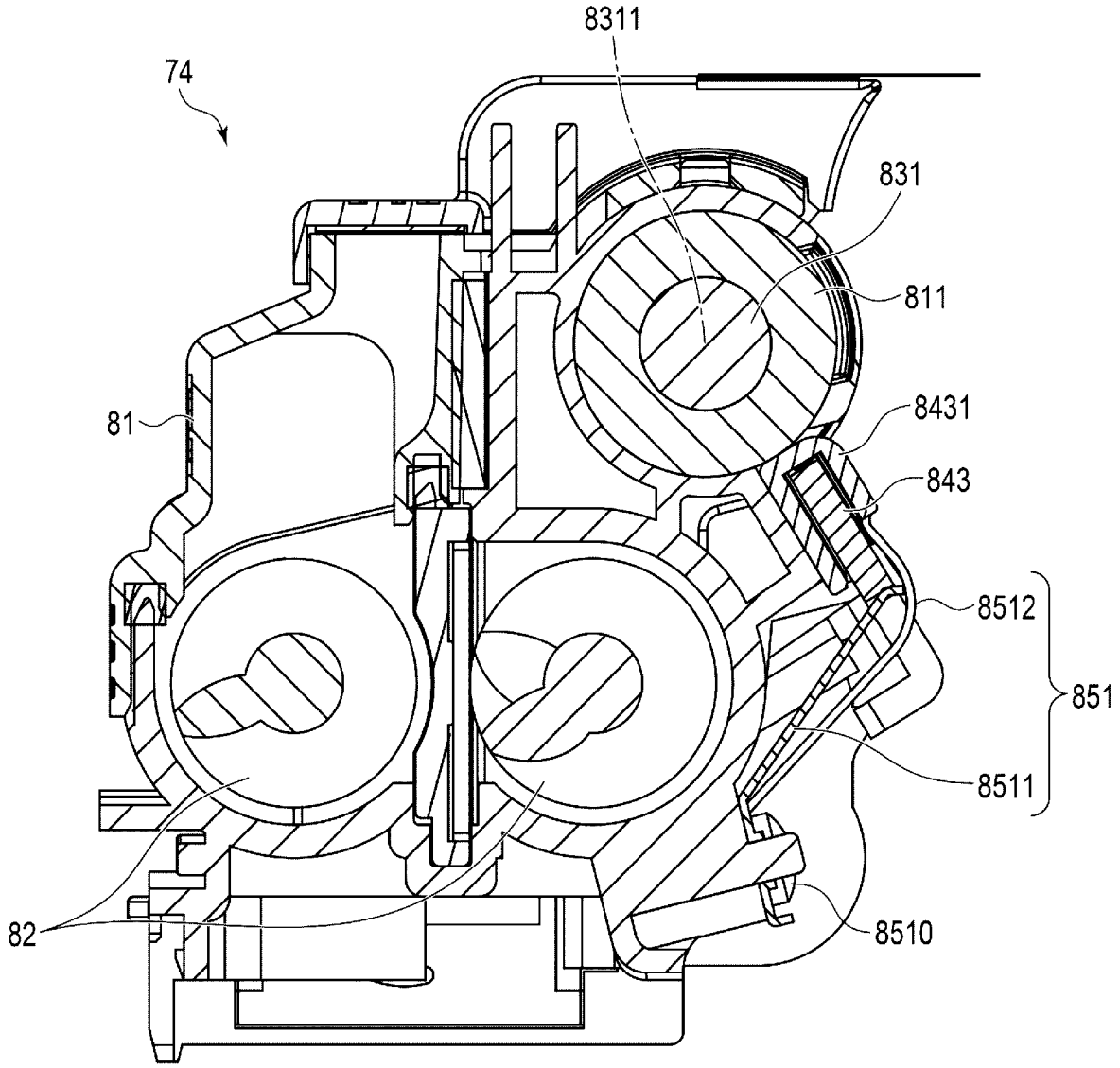
FIG. 4 is a sectional view taken along a IV-IV line in FIG. 3.
Figure 5:
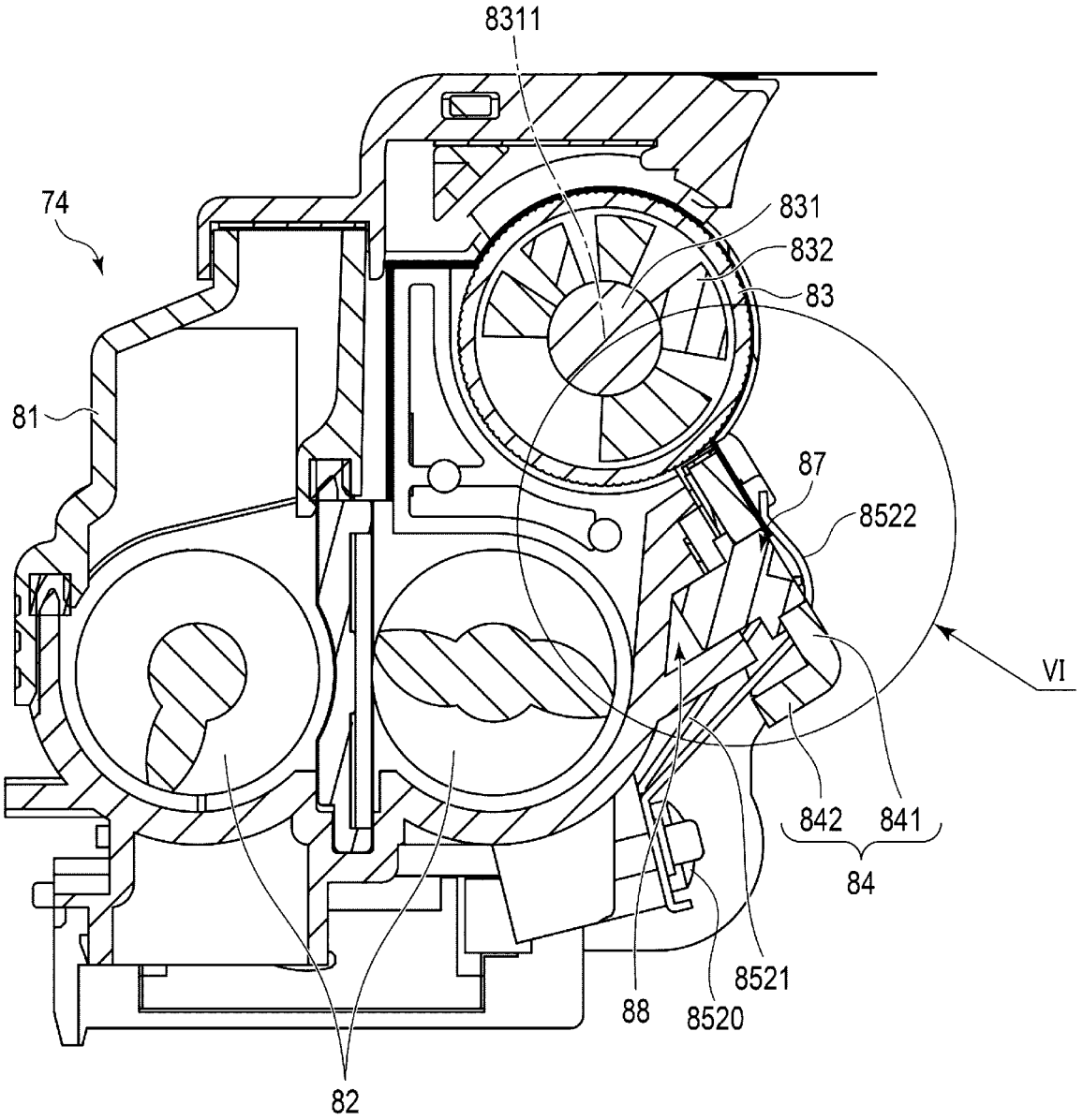
FIG. 5 is a sectional view taken along a V-V line in FIG. 3.
Figure 6:
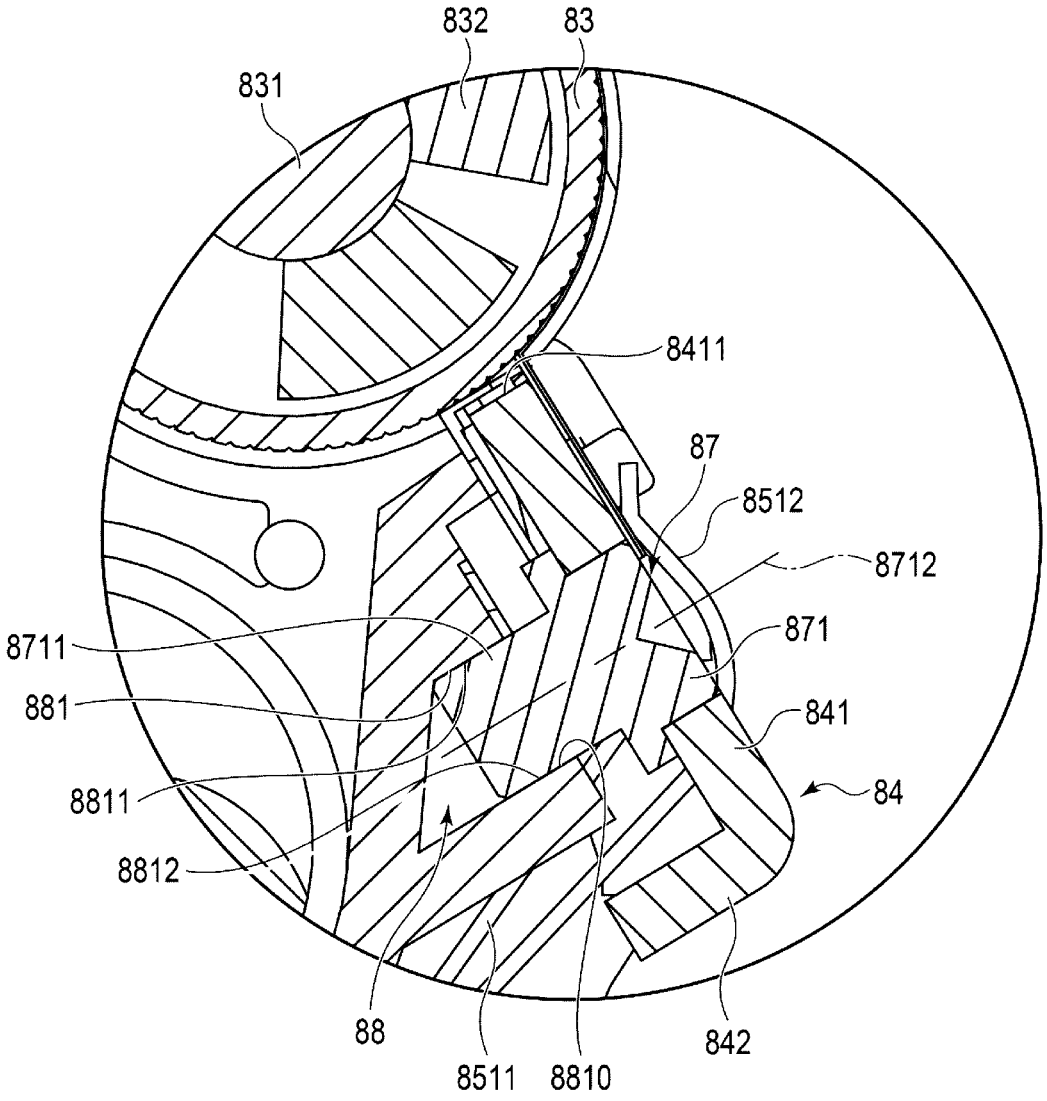
FIG. 6 is an enlarged view of a region indicated by a sign VI in FIG. 5.
Figure 7:
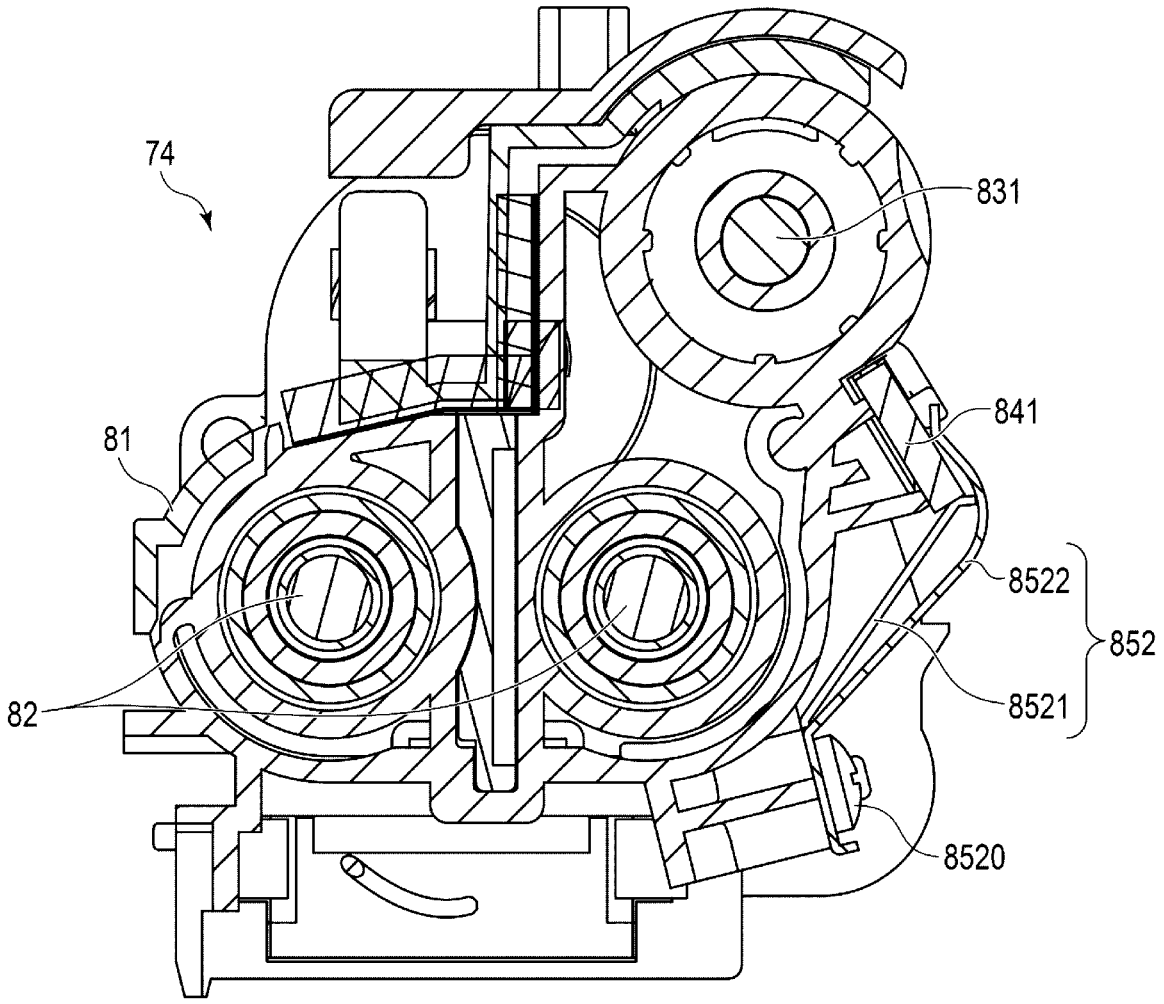
FIG. 7 is a sectional view taken along a VII-VII line in FIG. 3.
Figure 8:
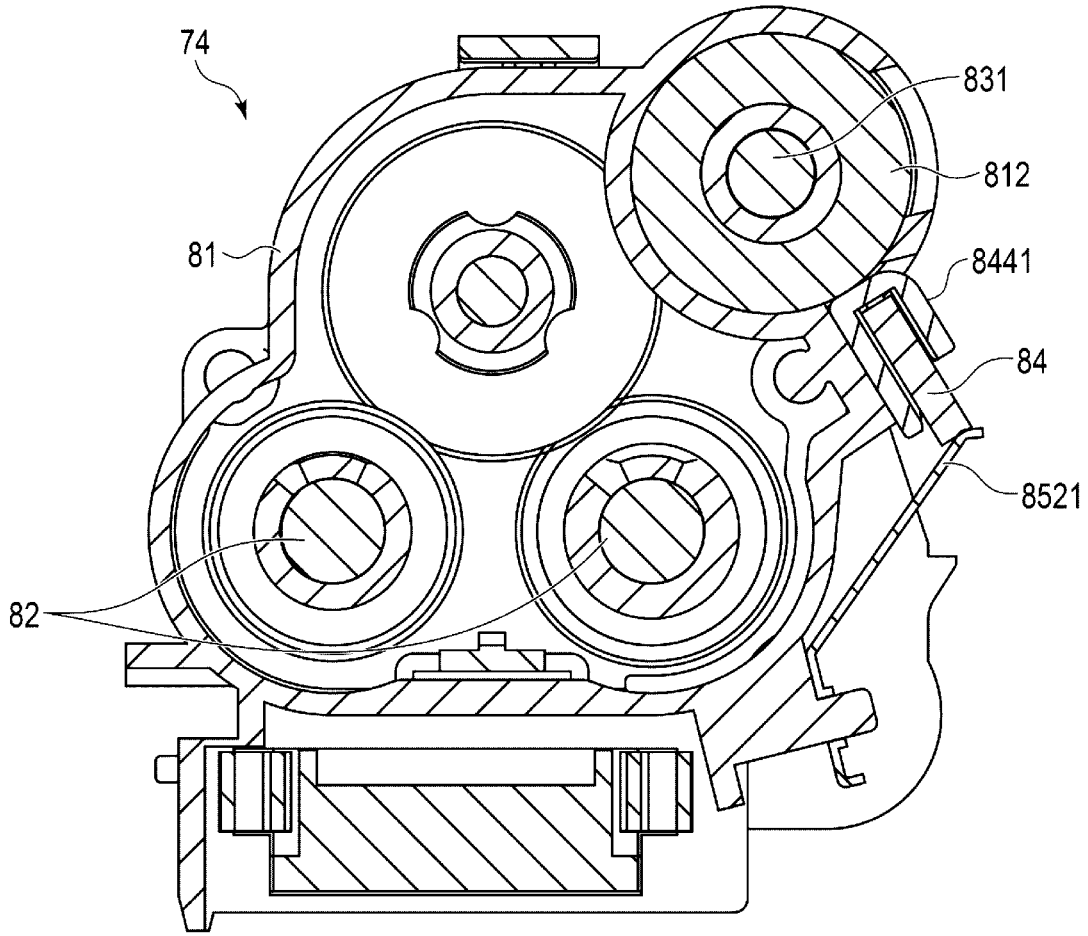
FIG. 8 is a sectional view taken along a VIII-VIII line in FIG. 3.
Figure 9:
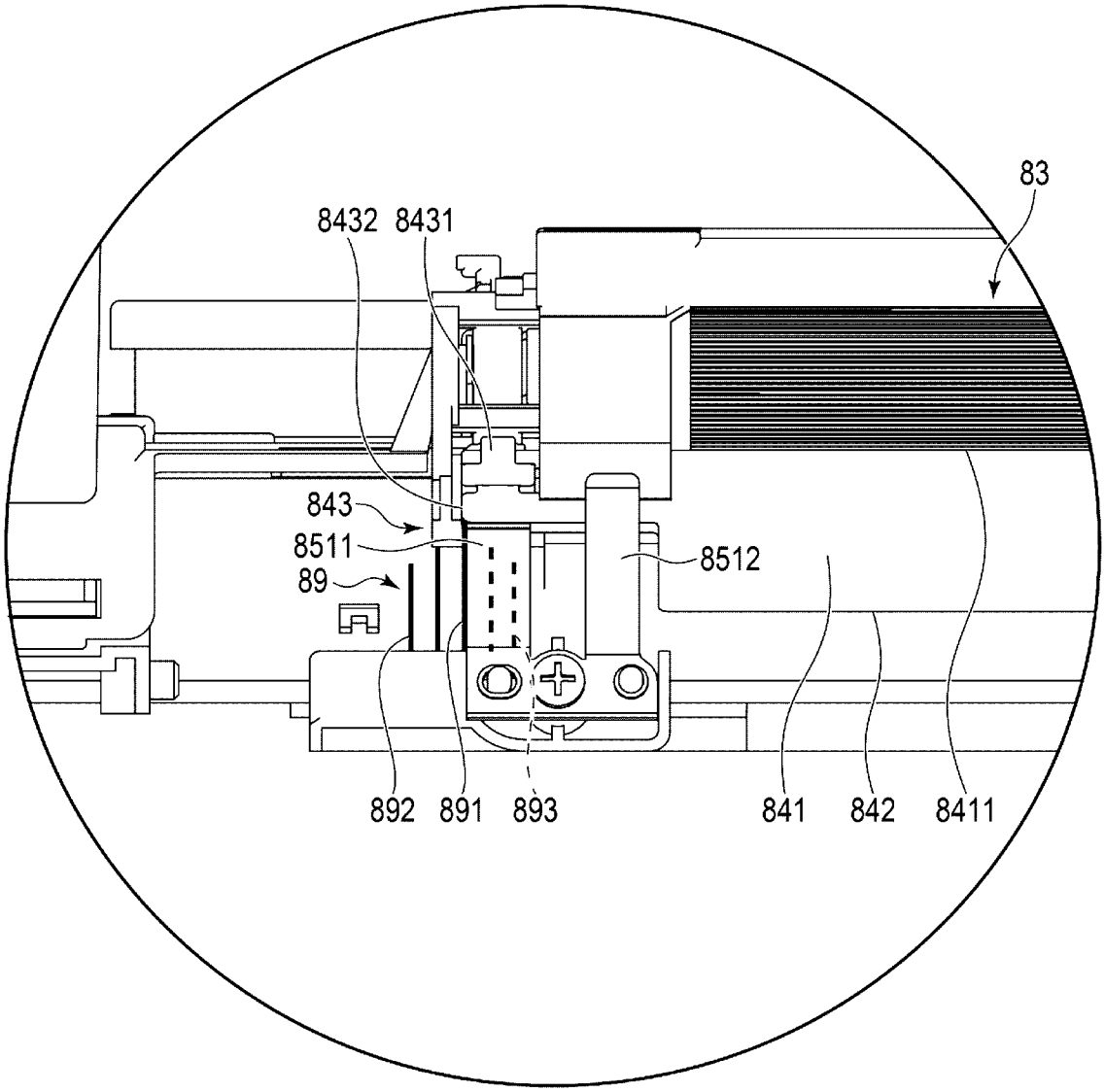
FIG. 9 is an enlarged view of a region indicated by a sign IX in FIG. 3.

FIG. 3 is a diagram illustrating the developing device 74 of the image forming unit 19. FIG. 4 is a sectional view taken along a IV-IV line in FIG. 3. FIG. 5 is a sectional view taken along a V-V line in FIG. 3. FIG. 6 is an enlarged view of a region indicated by a sign VI in FIG. 5. FIG. 7 is a sectional view taken along a VII-VII line in FIG. 3. FIG. 8 is a sectional view taken along a VIII-VIII line in FIG. 3. FIG. 9 is an enlarged view of a region indicated by a sign IX in FIG. 3.

Figure 10:
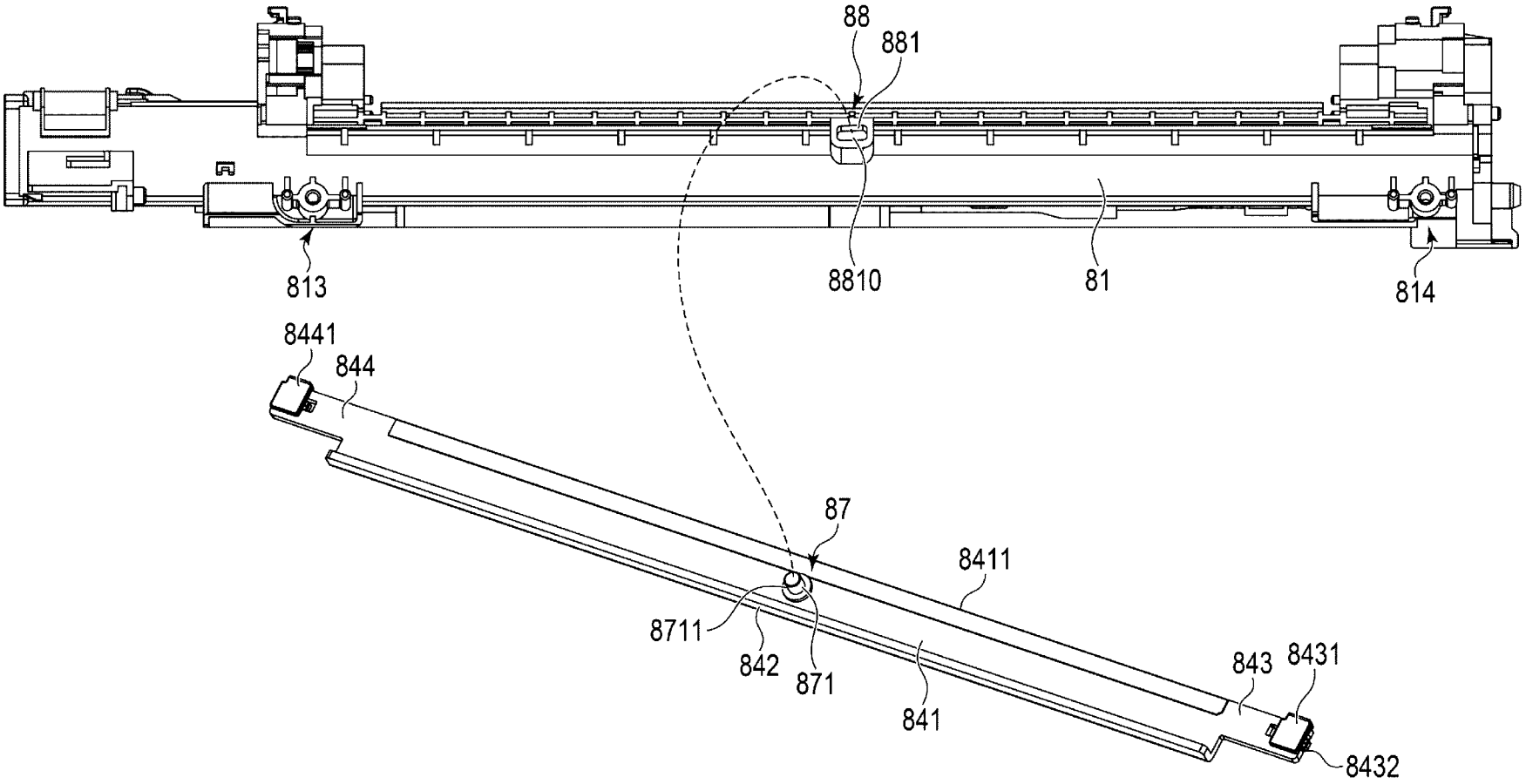
FIG. 10 is an exploded view of a developing case and a doctor blade.
Figure 11:
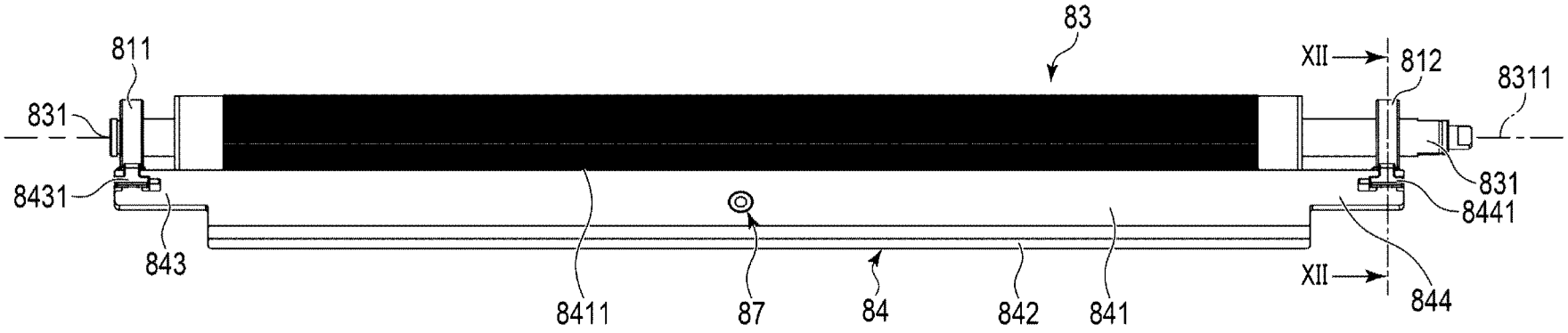
FIG. 11 is a schematic diagram illustrating a positional relation among a pair of bearings of the developing case, a developing sleeve, and the doctor blade.
Figure 12:
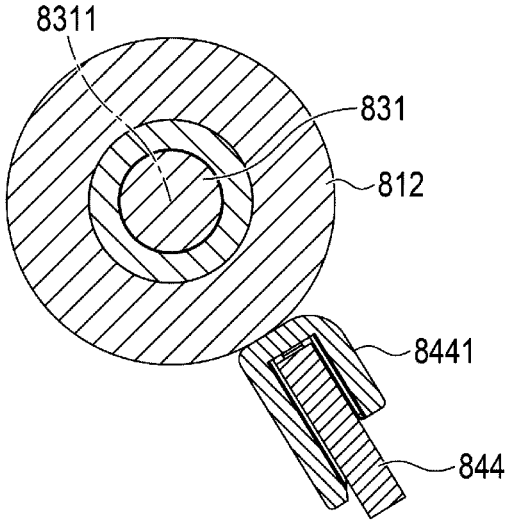
FIG. 12 is a sectional view taken along a XII-XII line in FIG. 11.
Figure 13:
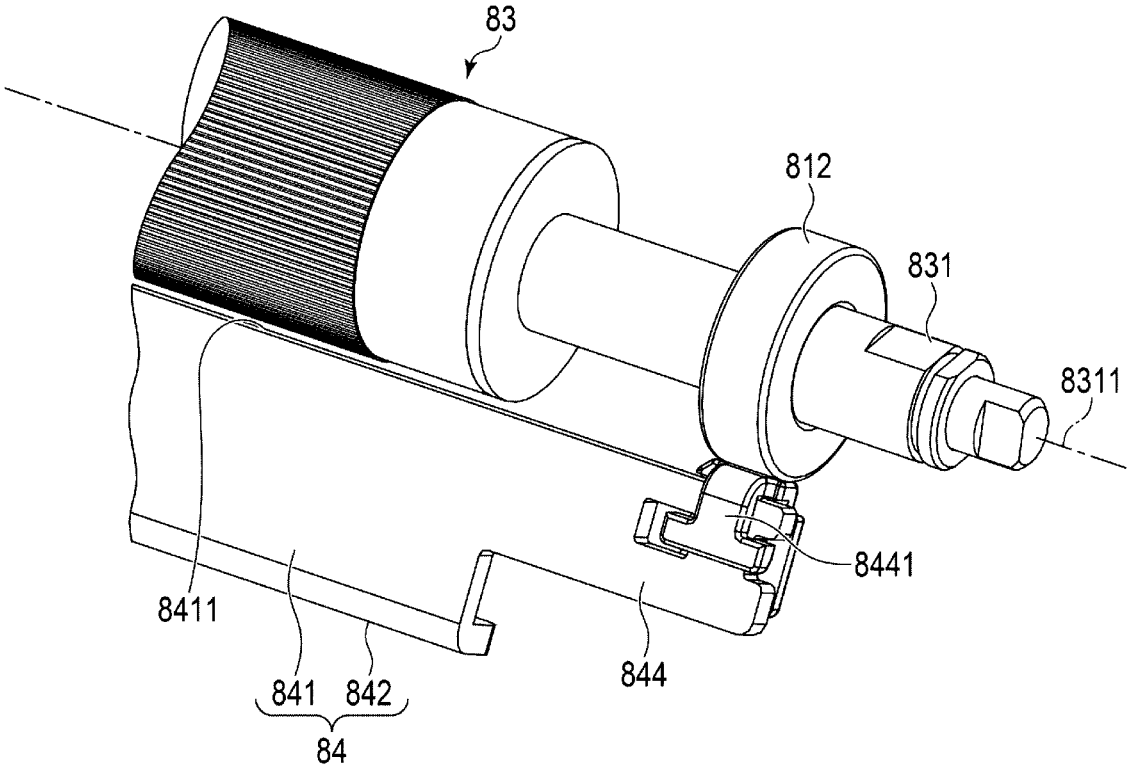
FIG. 13 is a schematic perspective view illustrating the other of the pair of bearings of the developing case, the developing sleeve, and the doctor blade illustrated in FIG. 11.

FIG. 10 is an exploded view of a developing case 81 and a doctor blade 84. FIG. 11 is a schematic view illustrating a positional relation among a pair of bearings 811 and 812 of the developing case 81, a developing sleeve 83, and the doctor blade 84. In FIG. 11, illustration of the developing case 81 excluding the pair of bearings 811 and 812 is omitted. FIG. 12 is a sectional view taken along a XII-XII line in FIG. 11. FIG. 13 is a schematic perspective view illustrating the vicinity of the other bearing 812 of the pair of bearings 811 and 812 of the developing case 81, the developing sleeve 83, and an end portion 844 of the doctor blade 84 illustrated in FIG. 11.

Figure 14:
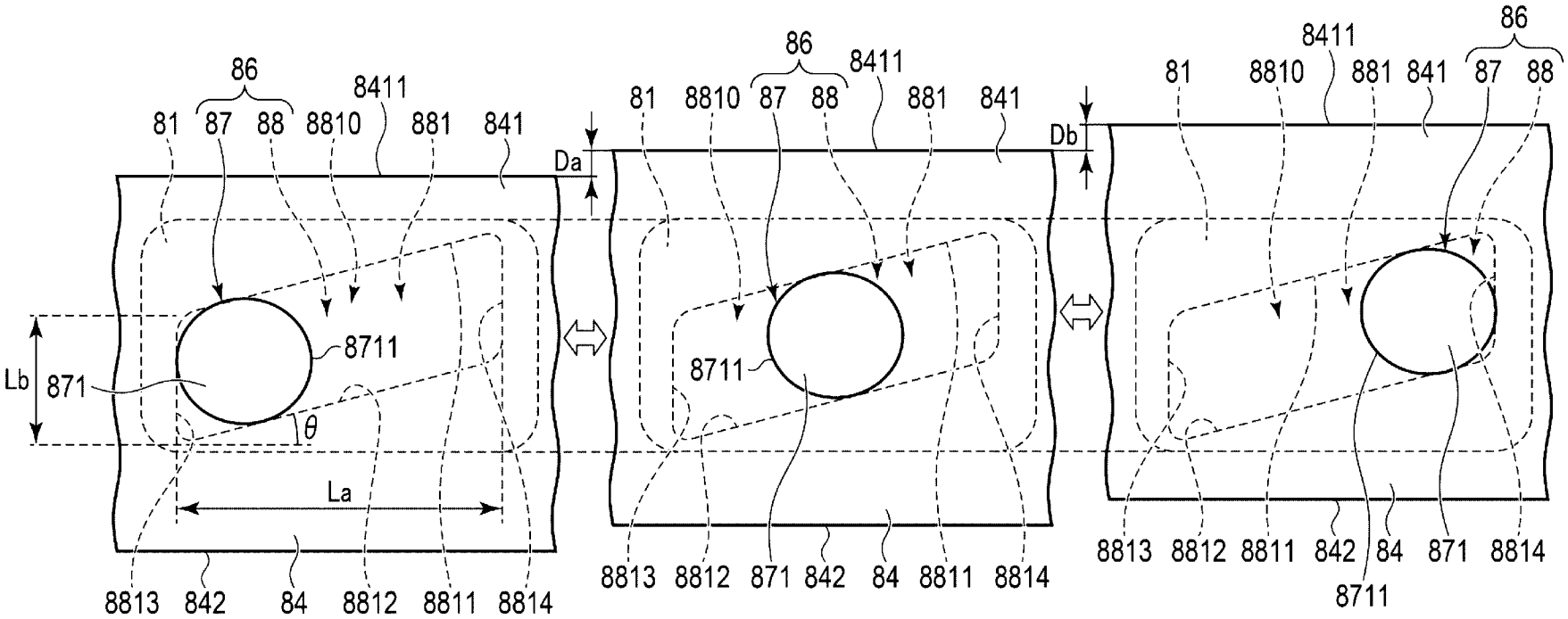
FIG. 14 is a schematic diagram illustrating a state in which a first engaging section (a shaft member) of the doctor blade moves, in the center in the longitudinal direction of the doctor blade, in a direction crossing the longitudinal direction with respect to a second engaging section (a recess) of the developing case of the developing device of the image forming unit according to the first embodiment.

FIG. 14 is a schematic diagram illustrating a state in which a first engaging section 87, which is indicated by a solid line, provided in the doctor blade 84 and a second engaging section 88, which is indicated by a broken line, provided in the developing case 81 are engaged. In FIG. 14, illustration of the developing sleeve 83 and the developing case 81 in which a recess 811 is provided is omitted.

The developing device 74 illustrated in FIGS. 2 to 9 is a device that causes toner to adhere to the photoconductive drum 71. The developing device 74 includes the developing case 81, agitating units 82, a developing sleeve (a magnet roller) 83, and the doctor blade 84.

The developing case 81 receives toner 75 fed out from the toner cartridge 2 by the toner feed-out mechanism 52. A carrier is stored in the developing case 81 at a manufacturing time of the developing device 74. Accordingly, the developing case 81 stores a developer 76 including the toner 75 and the carrier agitated together with the toner 75.

The agitating units 82 are provided in the developing case 81. The agitating units 82 are driven by a not-illustrated motor. The agitating units 82 agitate the toner 71 and the carrier in the developing case 81. That is, the agitating units 82 agitate the developer 76.

The developing sleeve 83 is cylindrical. The developing sleeve 83 includes a rotating shaft 831 projecting in the longitudinal direction from both end portions of a cylinder of the developing sleeve 83. One end of the rotating shaft 831 of the developing sleeve 83 is supported by the bearing 811 (see FIGS. 4 and 11) at one end of the developing case 81. The other end of the rotating shaft 831 of the developing sleeve 83 is supported by the bearing 812 (see FIGS. 8 and 11 to 13) at the other end of the developing case 81. Since the rotating shaft 831 of the developing sleeve 83 is supported by the pair of bearings 811 and 812 of the developing case 81, the developing sleeve 83 rotates with respect to the developing case 81. The longitudinal direction length of the outer surface of the cylinder of the developing sleeve 83 is, for example, larger than the transverse direction length of A4 paper. The cylinder of the developing sleeve 83 attracts the developer to the outer surface of the cylinder of the developing sleeve 83 using a magnetic force of a magnet 832 disposed on the inner side of the developing sleeve 83. Accordingly, if the developing sleeve 83 rotates with respect to the developing case 81, the developer adheres to the outer surface of the cylinder of the developing sleeve 83.

A movable range along the longitudinal direction of the doctor blade 84 with respect to the developing case 81 is set according to a contact length of gap members 8431 and 8441 and the bearings 811 and 812 along the longitudinal direction of the doctor blade 84. The outer circumferential surfaces of the bearings 811 and 812 are formed as cylinders around a center axis 8311 of the rotating shaft 831 of the developing sleeve 83. The length of the outer circumferential surfaces of the bearings 811 and 812 along the longitudinal direction of the doctor blade 84 is, for example, approximately 10 mm to 20 mm.

The doctor blade 84 is formed, for example, symmetrically with respect to the V-V line in FIG. 3. The doctor blade 84 includes a substantially rectangular plate-like blade section 841 long in a longitudinal direction, which a direction parallel to the center axis 8311 of the developing sleeve 83, and a rib 842 integral with one end portion of a pair of end portions extending along the longitudinal direction of the blade section 841. The surface of the rib 842 is bent at substantially 90 degrees with respect to the surface of the blade section 841. Accordingly, the rib 842 prevents the blade section 841 from bending. Both end portions 843 and 844 extending along the longitudinal direction of the doctor blade 84 are supported by a pair of supporting sections 851 and 852 explained below with respect to the developing case 81.

An end face 8411 of the blade section 841 of the doctor blade 84 on the opposite side of the rib 842 has straightness. The end face 8411 of the blade section 841 of the doctor blade 84 is disposed with a predetermined gap between the end face 8411 and the outer surface of the developing sleeve 83. The end face 8411 of the blade section 841 of the doctor blade 84 removes a part of the developer adhering to the outer surface of the rotating developing sleeve 83. Consequently, the doctor blade 84 forms, on the outer surface of the developing sleeve 83, a layer of the developer having thickness corresponding to the interval between the end face 8411 of the doctor blade 84 and the outer surface of the developing sleeve 83.

The length along the longitudinal direction of the end face 8411 of the blade section 841 of the doctor blade 84 is, for example, larger than the transverse direction length of the A4 paper. The length along the longitudinal direction of the end face 8411 of the blade section 841 of the doctor blade 84 is the same as or larger than the longitudinal direction length of the outer surface of the developing sleeve 83.

The length along the transverse direction of the blade section 841 of the doctor blade 84 is, for example, approximately 14 mm. A total of the transverse direction length of the blade section 841 and the thickness of the rib 842 is, for example, approximately 16 mm.

As illustrated in FIGS. 4 and 9 to 11, the gap member (a gap spacer) 8431 is provided at one end portion 843 in the longitudinal direction of the doctor blade 84. The gap member 8431 is provided between the outer circumferential surface of one bearing 811 and the end portion 843 of the doctor blade 84. A contact length of the gap member 8431 and the outer circumferential surface of one bearing 811 along the longitudinal direction of the doctor blade 84 is, for example, approximately 10 mm to 20 mm. As illustrated in FIGS. 8 and 10 to 13, the gap member (a gap spacer) 8441 is provided at the other end portion 844 in the longitudinal direction of the doctor blade 84. The gap member 8441 is provided between the outer circumferential surface of the other bearing 812 and the end portion 844 of the doctor blade 84. A contact length of the gap member 8441 and the outer circumferential surface of the other bearing 812 along the longitudinal direction of the doctor blade 84 is, for example, approximately 10 mm to 20 mm. The gap members 8431 and 8441 are formed at the same thickness.

The distance between scales 892 and 893 of an indicator 89 explained below is a distance for maintaining contact of the gap member 8431 and the outer circumferential surface of the bearing 811 and maintaining contact of the gap member 8441 and the outer circumferential surface of the bearing 812.

As illustrated in FIGS. 3 to 9, in the developing case 81, a pair of supporting sections 851 and 852 is provided to be separated in the longitudinal direction of the doctor blade 84. One supporting section 851 supports one end portion 843 in the longitudinal direction of the doctor blade 84 with respect to the developing sleeve 83 and the developing case 81. The other supporting section 852 supports the other end portion 844 in the longitudinal direction of the doctor blade 84. One supporting section 851 is fixed to a fixing section (a supporting-section fixing section) 813 of the developing case 81 illustrated in FIG. 10 by a screw 8510 or the like. The other supporting section 852 is fixed to a fixing section (a supporting-section fixing section) 814 of the developing case 81 illustrated in FIG. 10 by a screw 8520 or the like illustrated in FIG. 3.

The distances between the gap members 8431 and 8441, between the fixing sections 813 and 814, and between the supporting sections 851 and 852 are, for example, larger than the transverse direction length of the A4 paper.

As illustrated in FIGS. 3, 4, and 9, one supporting section 851 includes a pair of leaf springs 8511 and 8512. As illustrated in FIGS. 3 and 5 to 8, the other supporting section 852 includes a pair of leaf springs 8521 and 8522.

As illustrated in FIGS. 3, 4, and 9, one leaf spring 8511 of the supporting section 851 presses an end face on the opposite side of the end face 8411 of the blade section 841 in the end portion 843 of the doctor blade 84 toward the center axis of the bearing 811. Accordingly, the leaf spring 8511 presses the gap member 8431 toward the center axis of the bearing 811. Therefore, the end portion 843 of the doctor blade 84 is pressed toward the center axis 8311 of the rotating shaft 831 of the developing sleeve 83 by the leaf spring 8511.

The other leaf spring 8512 of the supporting section 851 presses the surface of the blade section 841 of the doctor blade 84 toward the developing case 81. A pressing direction in which the other leaf spring 8512 of the supporting section 851 presses the surface of the blade section 841 of the doctor blade 84 toward the developing case 81 is, for example, a direction parallel or substantially parallel to a center axis 8712 of a shaft member 871 explained below.

Accordingly, at the end portion 843 of the doctor blade 84 and near the end portion 843, the end face 8411 of the doctor blade 84 is separated at a predetermined interval from the outer circumferential surface of the developing sleeve 83 by the gap member 8431.

Similarly, as illustrated in FIGS. 3 and 5 to 8, one leaf spring 8521 of the supporting section 852 presses an end face on the opposite side of the end face 8411 of the blade section 841 in the end portion 844 of the doctor blade 84 toward the center axis of the bearing 812. Accordingly, the leaf spring 8521 presses the gap member 8411 toward the center axis of the bearing 812. Therefore, as illustrated in FIGS. 11 to 13, the end portion 844 of the doctor blade 84 is pressed toward the center axis 8311 of the rotating shaft 831 of the developing sleeve 83.

As illustrated in FIGS. 3 and 5 to 7, the other leaf spring 8522 of the supporting section 852 presses the surface of the blade section 841 of the doctor blade 84 toward the developing case 81. A pressing direction in which the other leaf spring 8522 of the supporting section 852 presses the surface of the blade section 841 of the doctor blade 84 toward the developing case 81 is, for example, a direction parallel or substantially parallel to the center axis 8712 of the shaft member 871.

Accordingly, at the end portion 844 of the doctor blade 84 or near the end portion 844, the end face 8411 of the blade section 841 of the doctor blade 84 is separated at the predetermined interval from the outer circumferential surface of the developing sleeve 83 by the gap member 8441.

In this way, both the end portions 843 and 844 of the doctor blade 84 are respectively supported from two directions with respect to the developing case 81. At both the end portions 843 and 844 along the longitudinal direction and near the end portions 843 and 844, the doctor blade 84 separates, with the gap members 8431 and 8441, the end face 8411 of the doctor blade 84 and the outer circumferential surface of the developing sleeve 83 at the predetermined interval.

Appropriate vibration is sometimes applied to the image forming apparatus 1, for example, at a transportation time, a use time, or the like of the image forming apparatus 1. Even in this case, the supporting sections 851 and 852 maintain the doctor blade 84 in a predetermined positional relation with the developing case 81. For example, the leaf springs 8511, 8512, 8521, and 8522 of the supporting sections 851 and 852 have spring strength for maintaining the doctor blade 84 in the predetermined positional relation with the developing case 81.

As illustrated in FIGS. 3, 5, 6, 10, 11, and 14, in this embodiment, the developing device 74 of the process unit 42 further includes an adjusting mechanism 86 that adjusts the distance (the gap) between the end face 8411 of the blade section 841 of the doctor blade 84 and the outer surface of the developing sleeve 83. The adjusting mechanism 86 is provided in the developing case 81 and the doctor blade 84. In this embodiment, the adjusting mechanism 86 includes the first engaging section 87 provided in the doctor blade 84 and the second engaging section 88 provided in the developing case 81.

As illustrated in FIGS. 3, 10, and 11, the first engaging section 87 of the doctor blade 84 is formed substantially in the middle in the longitudinal direction between both the end portions 843 and 844 of the doctor blade 84 long in the longitudinal direction and substantially in the middle in the transverse direction between the end face 8411 and the rib 842 of the doctor blade 84. The first engaging section 87 is, for example, fixed substantially in the middle between both the end portions 843 and 844 of the doctor blade 84 and substantially in the middle between the end face 8411 and the rib 842. As illustrated in FIGS. 5, 6, 10, and 14, in this embodiment, the first engaging section 87 includes, for example, the shaft member 871 including a substantially columnar fitting section 8711. As illustrated in FIG. 6, the center axis 8712 of the shaft member 871 crosses, for example, is orthogonal to the surface of the blade section 841 of the doctor blade 84.

As illustrated in FIG. 10, the second engaging section 88 of the developing case 81 is formed substantially in the middle between the fixing sections 813 and 814 disposed at both end portions of the developing case 81 long in the longitudinal direction. The longitudinal direction of the developing case 81 is a direction parallel to the center axis 8311 of the developing sleeve 83.

As illustrated in FIGS. 5, 6, 10, and 14, the second engaging section 88 includes a recess 881. As illustrated in FIGS. 5, 6 and 14, the recess 881 includes a substantially rectangular opening 8810 having size in which the outer edge of the fitting section 8711 of the shaft member 871 of the first engaging section 87 is fit. As illustrated in FIG. 14, the opening 8810 of the recess 881 is formed substantially in a parallelogram shape long in the longitudinal direction of the developing case 81. The opening 8810 of the recess 881 has long sides functioning as a pair of guide sections 8811 and 8812 and a pair of short sides 8813 and 8814 shorter than the pair of guide sections 8811 and 8812.

The pair of guide sections 8811 and 8812 is not parallel but is inclined in the longitudinal direction of the developing case 81. That is, the pair of guide sections 8811 and 8812 is not parallel but is inclined with respect to the end face 8411 of the blade section 841 of the doctor blade 84. For example, the pair of guide sections 8811 and 8812 are inclined at an angle θ ($0<\theta<90°$) with respect to the end face 8411 of the blade section 841 of the doctor blade 84. The pair of guide sections 8811 and 8812 may be formed as curved surfaces. In this embodiment, the pair of guide sections 8811 and 8812 is explained as planes parallel to each other.

In this embodiment, an example is explained in which the pair of guide sections 8811 and 8812 in FIG. 14 is inclined further to the upper side toward the right side in FIG. 14. The pair of guide sections 8811 and 8812 is also suitably inclined further to the upper side toward the left side in FIG. 14.

The pair of short sides 8813 and 8814 crosses the longitudinal direction of the developing case 81. In this embodiment, the pair of short sides 8813 and 8814 is, for example, orthogonal to the longitudinal direction of the developing case 81.

Length (length in the transverse direction) Lb of the pair of short sides 8813 and 8814 of the recess 881 is length for allowing the outer edge of the fitting section 8711 of the shaft member 871 to fit between the pair of guide sections 8811 and 8812 of the recess 881. Accordingly, a diameter of the fitting section 8711 of the shaft member 871 is calculated as $Lb\times\sin(90°-\theta)=Lb\times\cos\theta$ using the angle θ. Since $0<\theta<90°$, the length Lb of the pair of short sides 8813 and 8814 of the recess 881 is larger than the diameter of the fitting section 8711 of the shaft member 871.

Length of the pair of guide sections 8811 and 8812 is calculated as $La/\cos\theta$ using the angle θ. La represents the distance between the short sides 8813 and 8814. Since $0<\theta<90°$, the length of the pair of guide sections 8811 and 8812 of the recess 881 is larger than the distance (the length of components in the longitudinal direction of the pair of guide sections 8811 and 8812 of the recess 881) La between the pair of short sides 8813 and 8814. The length La of the components in the longitudinal direction of the pair of guide sections 8811 and 8812 of the recess 881 is larger than the length for allowing the outer edge of the fitting section 8711 of the shaft member 871 to fit in the recess 881. Accordingly, in this embodiment, the recess 881 is formed as a recessed hole long in the longitudinal direction.

The recess 881 has a shape for allowing the fitting section 8711 of the shaft member 871 to enter the depth side of the recess 881 by a predetermined length along the center axis 8712 of the shaft member 871 through the opening 8810. Accordingly, the recess 881 has a shape for allowing the fitting section 8711 of the shaft member 871 to move between the short sides 8813 and 8814 along the pair of guide sections 8811 and 8812.

As illustrated in FIG. 9, near a position where the end portion 843 of the doctor blade 84 is disposed in the developing case 81, the indicator 89 indicating a moving range in which the doctor blade 84 moves in the longitudinal direction with respect to the developing case 81 is attached.

The indicator 89 is disposed at a predetermined interval, for example, every 1 mm or 2 mm. In this embodiment, as the indicator 89, five scales equally dividing a moving range in which the doctor blade 84 moves in the longitudinal direction into four are attached to the developing case 81. Accordingly, the five scales are separated at a predetermined interval along the longitudinal direction of the developing case 81.

In this embodiment, the indicator 89 includes, in the center, for example, a scale 891 longest in a direction orthogonal to the longitudinal direction. The scale 892 on the leftmost side in FIG. 9 is shorter than the scale 891 in the center. The scale 893 on the rightmost side in FIG. 9 is shorter than the scale 891 in the center. For example, if the scale 891 in the center in FIG. 9 overlaps an edge portion 8432 at the left end of the end portion 843 of the doctor blade 84, as illustrated in the center figure in FIG. 14, the fitting section 8711 of the shaft member 871 is located substantially in the center between the short sides 8813 and 8814. For example, if the scale 892 on the leftmost side in FIG. 9 overlaps the edge portion 8432 at the left end of the end portion 843 of the doctor blade 84, as illustrated in the left figure in FIG. 14, the fitting section 8711 of the shaft member 871 is in contact with one short side 8813. For example, if the scale 893 on the rightmost side in FIG. 9 overlaps the edge portion 8432 at the left end of the end portion 843 of the doctor blade 84, as illustrated in the right figure in FIG. 14, the fitting section 8711 of the shaft member 871 is in contact with the other short side 8814.

The adjusting mechanism 86 is adjusted such that, every time the doctor blade 84 moves by one scale of the indicator 89 along the longitudinal direction thereof, the end face 8411 of the blade section 841 of the doctor blade 84 approaches or separates from the outer surface of the developing sleeve 83 by a predetermined distance.

The distance between the scales 892 and 893 of the indicator 89 coincides with, for example, the length La.

The exposing device 43 illustrated in FIG. 2 is explained.

The exposing device 43 includes a plurality of light emitting elements. The exposing device 43 irradiates the charged photoconductive drum 71 with lights from the light emitting elements to thereby form a latent image on the photoconductive drum 71. The light emitting elements are, for example, light emitting diodes (LEDs) or laser diodes (LDs). One light emitting element irradiates one point on the photoconductive drum 71 with light. The plurality of light emitting elements are arrayed in a main scanning direction, which is a direction parallel to the rotation axis of the photoconductive drum 71.

The exposing device 43 irradiates, with the plurality of light emitting elements arrayed in the main scanning direction, the photoconductive drum 71 with lights to thereby form a latent image for one line on the photoconductive drum 71. Further, the exposing device 43 continuously irradiates the rotating photoconductive drum 71 with lights to thereby form latent images for a plurality of lines.

In the configuration explained above, if the surface of the photoconductive drum 71 charged by the electrifying charger 73 is irradiated with light from the exposing device 43, an electrostatic latent image is formed on the surface of the photoconductive drum 71. If a layer of the developer formed on the surface of the developing sleeve 83 approaches the surface of the photoconductive drum 71, the toner included in the developer adheres to the latent image formed on the surface of the photoconductive drum 71. Consequently, a toner image is formed on the surface of the photoconductive drum 71.

The transfer mechanism 44 illustrated in FIG. 1 is explained.

The transfer mechanism 44 is a components that transfers the toner image formed on the surface of the photoconductive drum 71 onto the printing medium p.

As illustrated in FIGS. 1 and 2, the transfer mechanism 44 includes, for example, a primary transfer belt 91, a secondary transfer counter roller 92, a plurality of primary transfer rollers 93, and a secondary transfer roller 94.

The primary transfer belt 91 is an endless belt wound on the secondary transfer counter roller 92 and a plurality of winding rollers. The surface on the inner surface (the inner circumferential surface) of the primary transfer belt 91 is in contact with the secondary transfer counter roller 92 and the plurality of winding rollers. The surface on the outer side (the outer circumferential surface) of the primary transfer belt 91 is opposed to the photoconductive drum 71 of the process unit 42.

The secondary transfer counter roller 92 is rotated by a not-illustrated motor. The secondary transfer counter roller 92 rotates to thereby convey the primary transfer belt 91 in a predetermined conveying direction. The plurality of winding rollers are capable of freely rotating. The plurality of winding rollers rotate according to the movement of the primary transfer belt 91 by the secondary transfer counter roller 92.

The plurality of primary transfer rollers 93 bring the primary transfer belt 91 into contact with the photoconductive drums 71 of the process units 42. The plurality of primary transfer rollers 93 respectively correspond to the photoconductive drums 71 of the plurality of process units 42. Specifically, the plurality of primary transfer rollers 93 are provided in positions opposed to, across the primary transfer belt 91, the photoconductive drums 71 of the process units 42 corresponding thereto. The primary transfer rollers 93 come into contact with the inner circumferential surface side of the primary transfer belt 91 to displace the primary transfer belt 91 to the photoconductive drum 71 side. Consequently, the primary transfer rollers 93 bring the outer circumferential surface of the primary transfer belt 91 into contact with the photoconductive drums 71.

The secondary transfer roller 94 is provided in a position opposed to the primary transfer belt 91. The secondary transfer roller 94 comes into contact with and applies pressure to the outer circumferential surface of the primary transfer belt 91. Consequently, a transfer nip where the secondary transfer roller 94 and the outer circumferential surface of the primary transfer belt 91 are closely attached is formed. If the printing medium P passes through the transfer nip, the secondary transfer roller 94 presses the printing medium P passing through the transfer nip against the outer circumferential surface of the primary transfer belt 91.

The secondary transfer roller 94 and the secondary transfer counter roller 92 rotate to thereby convey, in a held state, the printing medium P supplied from the paper feed conveying path 31. Consequently, the printing medium P passes through the transfer nip.

In the configuration explained above, if the outer circumferential surface of the primary transfer belt 91 comes into contact with the photoconductive drum 71, the toner image formed on the surface of the photoconductive drum 71 is transferred onto the outer circumferential surface of the primary transfer belt 91. If the image forming unit 19 includes the plurality of process units 42 as illustrated in FIG. 1, the primary transfer belt 91 receives toner images from the photoconductive drums 71 of the plurality of process units 42. The toner image transferred onto the outer circumferential surface of the primary transfer belt 91 is conveyed to, by the primary transfer belt 91, the transfer nip where the secondary transfer roller 94 and the outer circumferential surface of the primary transfer belt 91 are closely attached. If the printing medium P is present in the transfer nip, the toner image transferred onto the outer circumferential surface of the primary transfer belt 91 is transferred onto the printing medium P in the transfer nip.

A configuration concerning fixing of the image forming apparatus 1 is explained.

The fixing device 20 melts the toner transferred onto the printing medium P and fixes the toner image. The fixing device 20 operates based on the control by the system controller 13. The fixing device 20 includes a heating member that applies heat to the printing medium P and a pressurizing member that applies pressure to the printing medium P. For example, the heating member is, for example, a heat roller 95. For example, the pressurizing member is a press roller 96.

The heat roller 95 is a rotating body for fixing rotated by a not-illustrated motor. The heat roller 95 includes a core bar formed of metal in a hollow shape and an elastic layer formed on the outer circumference of the core bar. The heat roller 95 is heated to high temperature by a heater disposed on the inner side of the core bar formed in the hollow shape. The heater is, for example, a halogen heater. The heater may be an induction heating (IH) heater that heats the core bar with electromagnetic induction.

The press roller 96 is provided in a position opposed to the heat roller 95. The press roller 96 includes a core bar formed of metal at a predetermined outer diameter and an elastic layer formed on the outer circumference of the core bar. The press roller 96 applies pressure to the heat roller 95 with stress applied from a not-illustrated tension member. The pressure is applied from the press roller 96 to the heat roller 95, whereby a nip (a fixing nip) where the press roller 96 and the heat roller 95 are closely attached is formed. The press roller 96 is rotated by a not-illustrated motor. The press roller 96 rotates to thereby move the printing medium P entering the fixing nip and presses the printing medium P against the heat roller 95.

With the configuration explained above, the heat roller 95 and the press roller 96 apply heat and pressure to the printing medium P passing through the fixing nip. Consequently, the toner image is fixed on the printing medium P having passed through the fixing nip. The printing medium P having passed through the fixing nip is guided to the paper discharge conveying path 32 and discharged to the outside of the housing 11.

Work for adjusting the distance (the gap) between the end face 8411 of the blade section 841 and the outer surface of the developing sleeve 83 in a section between the end portions 843 and 844 of the doctor blade 84 using the adjusting mechanism 86 after manufacturing of the developing device 74 is explained. This work may be performed after the image forming apparatus 1 including the developing device 74 is manufactured. This work may be performed at a maintenance time of the image forming apparatus 1.

An operator moves the doctor blade 84 along the longitudinal direction of the developing case 81 to thereby adjust the distance between the end face 8411 of the blade section 841 and the outer surface of the developing sleeve 83 in a section between the end portions 843 and 844 of the doctor blade 84. The position of the developing sleeve 83 is not adjusted with respect to the developing case 81 after the developing device 74 is manufactured.

The operator views the developing case 81, the developing sleeve 83, and the doctor blade 84 of the developing device 74, for example, from a direction illustrated in FIG. 3. If the developing device 74 is once manufactured, as illustrated in FIG. 9, the edge portion 8432 at the left end of the end portion 843 of the doctor blade 84 and the longest scale 891 of the indicator 89 are superimposed. This position is represented as an initial position of the doctor blade 84 with respect to the developing case 81 and the developing sleeve 83. If the doctor blade 84 is in the initial position, as illustrated in the center figure among three figures in FIG. 14, the fitting section 8711 of the shaft member 871 is disposed in substantially the center between the pair of short sides 8813 and 8814.

The gap between both the end portions 843 and 844 of the doctor blade 84 and the outer surface of the developing sleeve 83 is represented as a predetermined gap. The distance between substantially the center of the end face 8411 of the blade section 841 and the outer surface of the developing sleeve 83 in the section between both the end portions 843 and 844 of the doctor blade 84 is represented as an initial gap.

The operator checks the difference between the predetermined gap between both the end portions 843 and 844 of the doctor blade 84 and the outer surface of the developing sleeve 83 and the gap (the initial gap) between substantially the center of the end face 8411 and the outer surface of the developing sleeve 83 in the section between both the end portions 843 and 844 of the doctor blade 84. If the difference between the predetermined gap and the initial gap is within an allowable range set as appropriate, work by the operator is unnecessary. If the difference between the predetermined gap and the initial gap is outside the allowable range, the operator performs the following work.

The operator moves the doctor blade 84 along the longitudinal direction with respect to the developing case 81 and the developing sleeve 83 resisting urging forces of the leaf springs 8511, 8512, 8521, and 8522 of the supporting sections 851 and 852. At this time, the operator maintains a state in which the gap member 8431 of the doctor blade 84 is set in contact with the outer circumferential surface of the bearing 811 of the developing case 81. The operator maintains a state in which the gap member 8441 of the doctor blade 84 is set in contact with the outer circumferential surface of the bearing 812 of the developing case 81. At this time, the gap between both the end portions 843 and 844 of the doctor blade 84 and the outer surface of the developing sleeve 83 is maintained at the predetermined gap. The movable range along the longitudinal direction of the doctor blade 84 is within a range in which a state in which the gap member 8441 of the doctor blade 84 is in contact with the bearing 812 is maintained if the gap member 8441 of the doctor blade 84 moves in the longitudinal direction with respect to the bearing 812.

The operator moves the doctor blade 84, for example, to the left side in FIGS. 3 and 9 with respect to the developing case 81 and the developing sleeve 83. As illustrated in the center figure and the left figure in FIG. 14, the fitting section 8711 of the shaft member 871 fixed to the doctor blade 84 is guided toward one short side 8813 along the guide sections 8811 and 8812 of the recess 881 of the developing case 81 and approaches the one short side 8813. The fitting section 8711 of the shaft member 871 comes into contact with the one short side 8813. The shaft member 871 in a position in the left figure in FIG. 14 moves, according to the angle θ, the end face 8411 of the blade section 841 of the doctor blade 84 in a direction orthogonal to the longitudinal direction of the doctor blade 84 by a distance Da with respect to the shaft member 871 in the position in the center figure in FIG. 14. At this time, the outer surface of the developing sleeve 83 and the end face 8411 of the blade section 841 of the doctor blade 84 move away from each other.

The operator moves the doctor blade 84, for example, to the right side in FIGS. 3 and 9 with respect to the developing case 81 and the developing sleeve 83. As illustrated in the center figure and the right figure in FIG. 14, the fitting section 8711 of the shaft member 871 fixed to the doctor blade 84 is guided toward the other short side 8814 along the guide sections 8811 and 8812 of the recess 881 of the developing case 81 and approaches the other short side 8814. The fitting section 8711 of the shaft member 871 comes into contact with the other short side 8814. The shaft member 871 in the position in the right figure in FIG. 14 moves, according to the angle θ, the end face 8411 of the blade section 841 of the doctor blade 84 in the direction orthogonal to the longitudinal direction of the doctor blade 84 by a distance Db with respect to the shaft member 871 in the position in the center figure in FIG. 14. At this time, the outer surface of the developing sleeve 83 and the end face 8411 of the blade section 841 of the doctor blade 84 approach.

In this way, as illustrated in FIG. 14, the fitting section 8711 of the shaft member 871 of the doctor blade 84 moves within the range (the predetermined range) of the opening 8810 of the recess 881 of the developing case 81.

Every time the doctor blade 84 moves along the longitudinal direction, the end face 8411 of the blade section 841 of the doctor blade 84 approaches or separates from the outer surface of the developing sleeve 83 according to a formula of "moving distance along the longitudinal direction×tan θ". The "moving direction along the longitudinal direction" is a moving distance in the longitudinal direction of the doctor blade 84 with respect to the developing case 81 at the end portions 843 and 844 of the blade section 841 of the doctor blade 84.

As the angle θ is smaller, the moving distance in which the end face 8411 of the blade section 841 of the doctor blade 84 moves in the direction orthogonal to the longitudinal direction of the doctor blade 84 with respect to the outer surface of the developing sleeve 83 decreases according to the movement along the longitudinal direction of the doctor blade 84. Conversely, as the angle θ is larger, the moving distance in which the end face 8411 of the blade section 841 of the doctor blade 84 moves in the direction orthogonal to the longitudinal direction of the doctor blade 84 with respect to the outer surface of the developing sleeve 83 increases according to the movement along the longitudinal direction of the doctor blade 84.

In this embodiment, the angle θ is set in advance and the distance for each one scale of the indicator 89 is set in advance. Accordingly, every time the operator moves the doctor blade 84 by one scale of the indicator 89 along the longitudinal direction with respect to the developing case 81, the operator can see in which degree the end face 8411 of the blade section 841 of the doctor blade 84 approaches or separates from the outer surface of the developing sleeve 83.

For example, if the operator moves the doctor blade 84 illustrated in FIG. 9 by two scales to the left side in FIG. 9 along the longitudinal direction and superimposes the edge portion 8432 of the end portion 843 of the doctor blade 84 on the scale 892 on the leftmost side, the doctor blade 84 shifts to a state of the left figure among the three figures in FIG. 14. At this time, the end face 8411 of the blade section 841 of the doctor blade 84 in the left figure in FIG. 14 separates from the outer surface of the developing sleeve 83 by the distance Da with respect to the end face 8411 of the blade section 841 of the doctor blade 84 in the center figure in FIG. 14.

For example, if the operator moves the doctor blade 84 illustrated in FIG. 9 by two scales to the right side in FIG. 9 along the longitudinal direction and superimposes the edge portion 8432 of the end portion 843 of the doctor blade 84 on the scale 893 on the rightmost side, the doctor blade 84 shifts to a state of the right figure among the three figures in FIG. 14. At this time, the end face 8411 of the blade section 841 of the doctor blade 84 in the right figure in FIG. 14 approaches the outer surface of the developing sleeve 83 by the distance Db with respect to the end face 8411 of the blade section 841 of the doctor blade 84 in the center figure in FIG. 14.

That is, the operator performs work for moving the doctor blade 84 in the longitudinal direction with respect to the developing case 81 such that the initial gap approaches the predetermined gap.

Based on the formula explained above, if the doctor blade 84 is moved 1 mm along the longitudinal direction when the angle θ is 5°, the outer surface of the developing sleeve 83 and the end face 8411 of the blade section 841 of the doctor blade 84 move approximately 0.09 mm. If the doctor blade 84 is moved 1 mm along the longitudinal direction when the angle θ is 10°, the outer surface of the developing sleeve 83 and the end face 8411 of the blade section 841 of the doctor blade 84 move approximately 0.18 mm. For example, if one scale is equivalent to 1 mm, the operator can see that the outer surface of the developing sleeve 83 and the end face 8411 of the blade section 841 of the doctor blade 84 approach or separate approximately 0.09 mm at each one scale.

In this way, according to a positional relation between the edge portion 8432 of the end portion 843 of the doctor blade 84 and the indicator 89 illustrated in FIG. 9, the operator recognizes an adjustment amount for the initial gap between the end face 8411 of the blade section 841 of the doctor blade 84 and the outer surface of the developing sleeve 83.

If the operator stops the doctor blade 84 from moving along the longitudinal direction with respect to the developing case 81 resisting the urging forces of the leaf springs 8511, 8512, 8521, and 8522 of the supporting sections 851 and 852, a state in which the doctor blade 84 is supported with respect to the developing case 81 is maintained. Accordingly, a positional relation between the doctor blade 84 and the outer surface of the developing sleeve 83 is maintained by the supporting sections 851 and 852.

The operator measures, again, the distance (the predetermined gap) between both the end portions 843 and 844 of the doctor blade 84 and the outer surface of the developing sleeve 83 and the distance (a post-adjustment gap) between the center of the end face 8411 of the blade section 841 and the outer surface of the developing sleeve 83 in the section between both the end portions 843 and 844 of the doctor blade 84. The operator confirms that the post-adjustment gap is within an allowable range with respect to the predetermined gap. The image forming apparatus 1 including the developing device 74 is shipped and used in this state. The operator may perform such adjustment work for the developing device 74 in a setting site of the image forming apparatus 1.

As a structure for adjusting the distance (the gap) between the end face 8411 of the blade section 841 of the doctor blade 84 of the developing device 74 and the outer surface of the developing sleeve 83, the recess 881 only has to be formed in the developing case 81 and the shaft member 871 only has to be formed in the doctor blade 84. Accordingly, a component that needs to be prepared anew is substantially only the shaft member 871.

The end face 8411 of the blade section 841 of the doctor blade 84 is formed in a state in which the distance between the end face 8411 and the outer surface of the developing sleeve 83 is substantially the same in all positions along the longitudinal direction. If the distance between the blade section 841 of the doctor blade 84 and the outer surface of the developing sleeve 83 is different depending on a position in the longitudinal direction, it has been necessary to perform work for reattaching the doctor blade 84 to the developing case 81 or replacing the doctor blade 84.

The developing device 74 according to this embodiment can adjust the distance (the gap) between the end face 8411 of the blade section 841 of the doctor blade 84 and the outer surface of the developing sleeve 83 by moving the doctor blade 84 within the range of the short sides 8813 and 8814 between the guide sections 8811 and 8812 with respect to the developing case 81. This work is only to push the shaft member 871 formed in the doctor blade 84 into the recess 881 formed in the developing case 81 to move the doctor blade 84 along the longitudinal direction and adjust an engaging position of the shaft member 871 and the recess 881. Accordingly, the operator can easily perform the work.

Accordingly, an adjustment method for the distance between the outer surface of the developing sleeve 83 of the image forming apparatus 1 and the end face 8411 of the doctor blade 84 includes moving the doctor blade 84 along the longitudinal direction of the doctor blade 84, changing the position of the shaft member 871 with respect to the recess 881 according to the movement in the longitudinal direction of the doctor blade 84, and adjusting the distance between the outer surface of the developing sleeve 83 and the end face 8411 of the doctor blade 84 according to the change in the position of the shaft member 871 with respect to the recess 881.

Accordingly, according to this embodiment, it is possible to reduce a work time for, for example, replacement of the doctor blade 84 and reduce a manufacturing time for the developing device 74 and the image forming apparatus 1.

In this way, with the developing device 74 according to this embodiment, it is possible to adjust the distance between the end face 8411 of the blade section 841 of the doctor blade 84 and the outer surface of the developing sleeve 83 by moving the doctor blade 84 in the longitudinal direction to adjust the position of the shaft member 871 of the doctor blade 84 with respect to the recess 881 of the developing case 81. Therefore, according to this embodiment, it is possible to provide the developing device 74 capable of adjusting the distance between the end face 8411 of the blade section 841 of the doctor blade 84 and the outer surface of the developing sleeve 83 and the image forming apparatus 1 including the developing device 74.

Second Embodiment

The developing device 74 of the image forming apparatus 1 according to the second embodiment is explained with reference to FIG. 15. This embodiment is a modification of the first embodiment. The same members as the members of or members having the same functions as the functions of the developing device 74 of the image forming apparatus 1 explained in the first embodiment are denoted by the same reference numerals and signs and detailed explanation of the members is omitted.

In the first embodiment, an example is explained in which the doctor blade 84 includes the shaft member 871 functioning as the first engaging section 87 and the developing case 81 includes the recess 881 functioning as the second engaging section 88. In this embodiment, as illustrated in FIG. 15, the shaft member 871 functioning as the first engaging section 87 is provided in the developing case 81. The recess 881 functioning as the second engaging section 88 is provided in the doctor blade 84.

Figure 15:
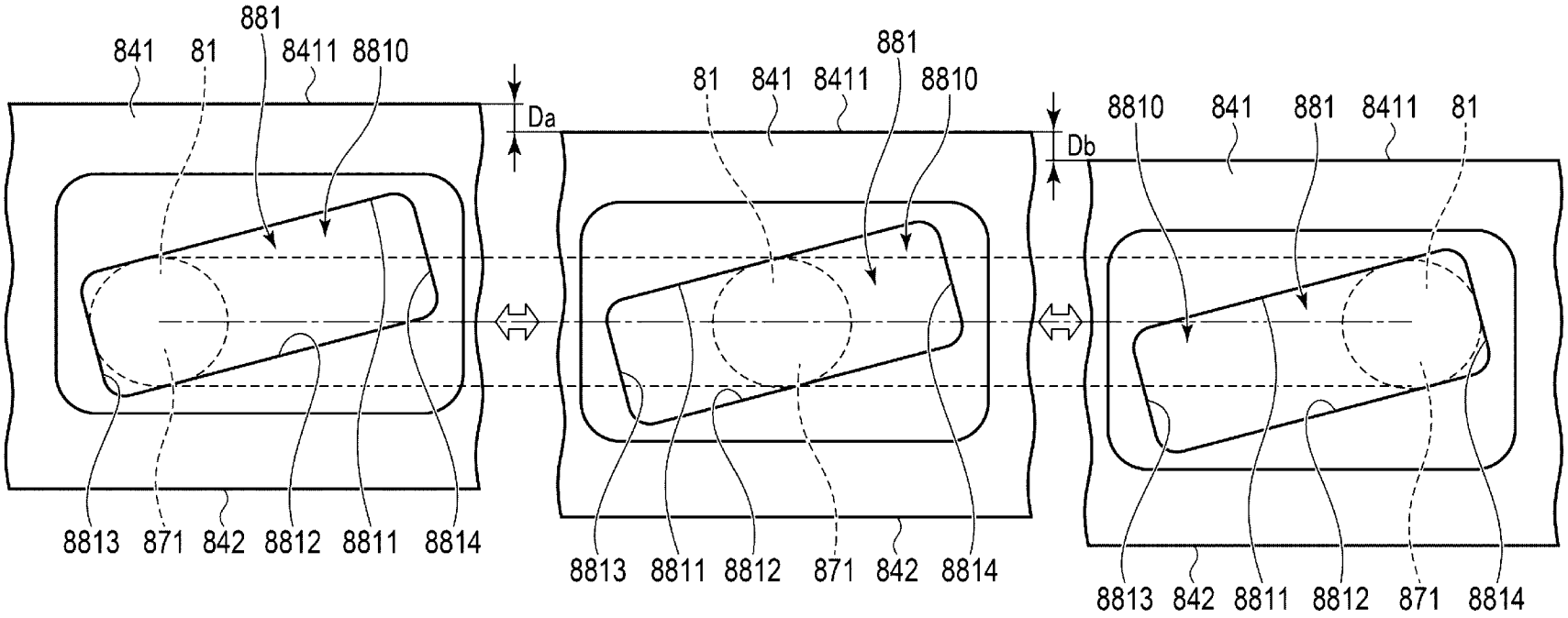
FIG. 15 is a schematic diagram illustrating a state in which a second engaging section (a recess) of a doctor blade moves, in the center in the longitudinal direction of the doctor blade, in a direction crossing the longitudinal direction with respect to a first engaging section (a shaft member) of the developing case of a developing device of an image forming unit according to a second embodiment.

FIG. 15 is a schematic diagram illustrating a state in which the second engaging section 88, which is indicated by a solid line, provided in the doctor blade 84 and the first engaging section 87, which is indicated by a broken line, provided in the developing case 81 are engaged. In FIG. 15, as in FIG. 14, illustration of the developing sleeve 83 and the developing case 81 in which the shaft member 871 is provided is omitted.

As illustrated in FIG. 15, the opening 8810 of the recess 881 may be formed in, for example, a substantially rectangular parallelepiped shape. In this case, not only the guide sections 8811 and 8812 but also the short sides 8813 and 8814 in FIG. 15 are inclined with respect to the longitudinal direction of the doctor blade 84 and a direction orthogonal to the longitudinal direction.

In this case as well, an operator moves the doctor blade 84 in the longitudinal direction of the doctor blade 84 with respect to the developing case 81, whereby the end face 8411 of the blade section 841 of the doctor blade 84 moves in the direction orthogonal to the longitudinal direction of the doctor blade 84. Therefore, the end face 8411 of the blade section 841 of the doctor blade 84 approaches or separates from the outer surface of the developing sleeve 83. The operator adjusts, according to necessity, the distance between the center of the end face 8411 and the outer surface of the developing sleeve 83 in a section between both the end portions 843 and 844 of the doctor blade 84 to a distance within a range allowed as a predetermined gap.

In this way, in the developing device 74, the shaft member 871 may be provided in the developing case 81 and the recess 881 may be provided in the doctor blade 84. In the developing device 74, the recess 881 may be provided in the developing case 81 and the shaft member 871 may be provided in the doctor blade 84.

An adjustment method for the distance between the outer surface of the developing sleeve 83 of the image forming apparatus 1 and the end face 8411 of the doctor blade 84 includes moving the doctor blade 84 along the longitudinal direction of the doctor blade 84, changing the position of the shaft member 871 with respect to the recess 881 according to the movement in the longitudinal direction of the doctor blade 84, and adjusting the distance between the outer surface of the developing sleeve 83 and the end face 8411 of the doctor blade 84 according to the change in the position of the shaft member 871 with respect to the recess 881.

Accordingly, according to this embodiment, it is possible to reduce a work time for, for example, replacement of the doctor blade 84 and reduce a manufacturing time for the developing device 74 and the image forming apparatus 1. Therefore, it is possible to provide the developing device 74 capable of adjusting the distance between the end face 8411 of the blade section 841 of the doctor blade 84 and the outer surface of the developing sleeve 83 and the image forming apparatus 1 including the developing device 74.

According to at least one embodiment explained above, it is possible to provide the developing device 74 capable of adjusting the distance between the doctor blade 84 and the outer surface of the developing sleeve 83 and the image forming apparatus 1 including the developing device 74.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a developing case configured to store a developer including a carrier and toner supplied from a toner cartridge;

a developing sleeve supported by the developing case at both ends and configured to cause the developer to adhere to an outer surface of the developing sleeve with a magnetic force;

a doctor blade including both end portions in a longitudinal direction supported by the developing case and a straight end face separated from the outer surface of the developing sleeve;

a first engaging structure provided in a center in the longitudinal direction of the doctor blade; and a second engaging structure provided in the developing case and configured to engage with the first engaging structure, wherein one of the first engaging structure and the second engaging structure includes a shaft member including a predetermined axis in a direction crossing the end face of the doctor blade, and the other of the first engaging structure and the second engaging structure includes a recess including a pair of guide structures inclined with respect to the end face of the doctor blade and guided in a state in which an outer edge of the shaft member is fit in the recess.

2. The image forming apparatus according to claim 1, wherein the recess comprises a recessed hole long in the longitudinal direction.

3. The image forming apparatus according to claim 1, wherein the pair of guide structures are parallel.

4. The image forming apparatus according to claim 1, wherein the recess includes a pair of short sides that forms an opening of the recess in conjunction with the pair of guide structures and are shorter with respect to the pair of guide structures.

5. The image forming apparatus according to claim 1, wherein in the shaft member, a fitting structure to be fit in the recess is formed in a columnar shape.

6. The image forming apparatus according to claim 1, further comprising:

a pair of bearings configured to support both end portions of the developing sleeve; and a spacer provided between both the end portions of the doctor blade and the bearings and pressurized toward a center axis of the bearings by both the end portions of the doctor blade.

7. The image forming apparatus according to claim 6, wherein a supporting structure configured to support both the end portions of the doctor blade toward the center axis of the bearings is provided in the developing case.

8. The image forming apparatus according to claim 7, wherein the supporting structure includes a leaf spring configured to support both the end portions of the doctor blade toward the center axis of the bearings.

9. The image forming apparatus according to claim 1, wherein the end face of the doctor blade and the predetermined axis of the shaft member are orthogonal.

10. The image forming apparatus according to claim 1, further comprising:

an indicator provided in the developing case and indicating a moving range of the doctor blade.

11. An adjustment method for a distance between an outer surface of a developing sleeve and an end face of a doctor blade of the image forming apparatus according to claim 1, the adjustment method comprising:

moving the doctor blade along the longitudinal direction of the doctor blade;

changing a position of the shaft member with respect to the recess according to the movement in the longitudinal direction of the doctor blade; and adjusting the distance between the outer surface of the developing sleeve and the end face of the doctor blade according to the change in the position of the shaft member with respect to the recess.

12. A developer handling device, comprising:

a developing case configured to store a developer including a carrier and toner supplied from a toner cartridge;

a developing sleeve supported by the developing case at both ends and configured to cause the developer to adhere to an outer surface of the developing sleeve with a magnetic force;

a doctor blade including both end portions in a longitudinal direction supported by the developing case and a straight end face separated from the outer surface of the developing sleeve;

a first engaging structure provided in a center in the longitudinal direction of the doctor blade; and a second engaging structure provided in the developing case and configured to engage with the first engaging structure, wherein one of the first engaging structure and the second engaging structure includes a shaft member including a predetermined axis in a direction crossing the end face of the doctor blade, and the other of the first engaging structure and the second engaging structure includes a recess including a pair of guide structures inclined with respect to the end face of the doctor blade and guided in a state in which an outer edge of the shaft member is fit in the recess.

13. The developer handling device according to claim 12, wherein the recess comprises a recessed hole long in the longitudinal direction.

14. The developer handling device according to claim 12, wherein the pair of guide structures are parallel.

15. The developer handling device according to claim 12, wherein the recess includes a pair of short sides that forms an opening of the recess in conjunction with the pair of guide structures and are shorter with respect to the pair of guide structures.

16. The developer handling device according to claim 12, wherein in the shaft member, a fitting structure to be fit in the recess is formed in a columnar shape.

17. The developer handling device according to claim 12, further comprising:

a pair of bearings configured to support both end portions of the developing sleeve; and a spacer provided between both the end portions of the doctor blade and the bearings and pressurized toward a center axis of the bearings by both the end portions of the doctor blade.

18. The developer handling device according to claim 17, wherein a supporting structure configured to support both the end portions of the doctor blade toward the center axis of the bearings is provided in the developing case.

19. The developer handling device according to claim 18, wherein the supporting structure includes a leaf spring configured to support both the end portions of the doctor blade toward the center axis of the bearings.

20. The developer handling device according to claim 12, wherein the end face of the doctor blade and the predetermined axis of the shaft member are orthogonal.

* * * * *